US006479723B1

(12) United States Patent
Malhotra et al.

(10) Patent No.: US 6,479,723 B1
(45) Date of Patent: Nov. 12, 2002

(54) PROCESS FOR CHEMICAL DESTRUCTION OF SULPHUR MUSTARD

(75) Inventors: Chandra Ramesh Malhotra, Gwalior (IN); Singh Balwant Batra, Gwalior (IN); Kumaran Ganesan, Gwalior (IN); Vaidyanatha Ramamoorthy Swamy, Gwalior (IN)

(73) Assignee: The Chief Controller, Research and Development, Defence Research and Development Organization of Ministry Defence, New Delhi (IN)

( * ) Notice: Subject to any disclaimer, the term of this patent is extended or adjusted under 35 U.S.C. 154(b) by 0 days.

(21) Appl. No.: 09/936,482

(22) PCT Filed: Aug. 20, 1999

(86) PCT No.: PCT/IN99/00040

§ 371 (c)(1),
(2), (4) Date: Nov. 30, 2001

(87) PCT Pub. No.: WO00/54846

PCT Pub. Date: Sep. 21, 2000

(30) Foreign Application Priority Data

Mar. 15, 1999 (IN) ..... 407/DEL/99

(51) Int. Cl.[7] ..... A62D 3/00
(52) U.S. Cl. ..... 588/200; 588/218; 588/242
(58) Field of Search ..... 588/200, 202, 588/205, 206, 215, 218, 238, 242

(56) References Cited

U.S. PATENT DOCUMENTS 5,387,717 A * 2/1995 Puckett et al. ..... 504/100
5,703,131 A * 12/1997 Puckett et al. ..... 504/100
5,760,089 A * 6/1998 Cronce ..... 514/643
5,998,691 A * 12/1999 Abel et al. ..... 149/124

OTHER PUBLICATIONS

Decontamination System of a Rapid Destruction of the Mustard Gas', Gu Weizhang et al., Proc. 3rd Int. Symp. Protection Against Chemical Warfare Agents, Sweden, Jun. 11–16, Jun. 1989, pp. 327–330.

"Chemicals in War", Kirk Othmer, Encyclopedia of Chemical Technology, New York, 6th Ed., vol. 5, 1993, pp. 795–815.

L. Zoran et al., Kinetics of the reaction of 2,2'–dichlordiethylsufide and 2–chlorethyl ethylsulfide with diethylenetriamine and triethylamin in 2–methoxyethanol, Naucno–Teh. Pregl. (1995), 45 (9)9–14, ISSN: 0350–0667, CA.*

* cited by examiner

*Primary Examiner*—Stanley S. Silverman
*Assistant Examiner*—Eileen E. Nave
(74) *Attorney, Agent, or Firm*—Venable; George H. Spencer; Ashley J. Wells

(57) ABSTRACT

A process for the chemical destruction of sulphur mustard by chemical conversion which comprises in the step of reacting sulphur mustard with a thiophilic agent prepared by dissolving sulphur in ethylenediamine and/or ethanol diamine.

7 Claims, No Drawings

PROCESS FOR CHEMICAL DESTRUCTION OF SULPHUR MUSTARD

FIELD OF INVENTION

The invention relates to an improved process for chemical destruction of Sulphur Mustard (SM) through chemical conversion of SM into non-toxic products.

PRIOR ART

Sulphur mustard (SM), chemically known as 1,1'-thiobis-(2-chloroethane) is a highly toxic and persistent liquid vesicant.

Methods known in the art for destruction of SM consist in high temperature reactions which involves destruction of SM by heating at high temperature. Such method comprise incineration, pyrolysis, plasma torch and molten metal system. Among all these high temperature reaction methods, incineration is a well proven method and is widely used. However, this method is attended with certain disadvantages.

The main disadvantage is that very high temperature of the order of 800–1200° C. is required to incinerate SM completely. Another disadvantage is that in the downstream of the process, large quantity of sodium hydroxide solution is required, through which toxic gases such as hydrogen chloride and sulphurdioxide formed in the reaction, have to be passed to neutralise them. Still another disadvantage is that despite neutralisatior of toxic gases by passing through sodium hydroxide solution, uncondensed gases like carbon monoxide, carbon dioxide etc. goes into the atmosphere which leads to pollution and as such the process is not ecofriendly. Yet another disadvantage is that large quantity of liquid effluent is generaged by the neutralisation of toxic gases by sodium hydroxide solution which causes environmental pollution. A further disadvantage is that the cost of destruction is very high. Another method known in the art for destruction of SM is chemical neutralisation technology which includes hydrolysis, oxidation and reductive degradation of SM. The chemical neutralisation method based on hydrolysis is also attended with several distinct disadvantages. One such disadvantage is that SM being sparingly soluble in water, the rate of hydrolysis of SM in water as well as in alkaline solution is very slow, hence the time required for complete neutralisation of SM is very high i.e ranging from 24–120 hours depending on the ratio of SM and water or alkali solution and the temperature at which the reaction is carried out.

Another disadvantage is that the product of hydrolysis of SM is thiodiglycol which can be reconverted to SM by passing hydrogen chloride gas and such a reversible reaction is not acceptable as per CW convention. Still another drawback is that a large quantity of liquid effluent is generated, so it is not ecofriendly.

In the chemical neutralisation method based on oxidation of SM, in which SM is detoxified to crystalline sulphoxide and sulphone using oxidising agents like hydrogen peroxide, potassium permanganate, p-chloroperbenzoic acid, chloramine-T and N-chloro-compounds is also attended with several disadvantages. The main disadvantage is that sulphone of SM, which is one of the product formed by oxidation, has vesicant properties and it is toxic in nature. Another disadvantage is that large quantities of gaseous, liquid and solid wastes are generated. Yet another disadvantage is that the cost of destruction of SM is very high as large quantity of oxidising agents are required. A further disadvantage is that oxidising agents such as hydrogen peroxide, p-chloro perbenzoic acid, chloramine-T and N-chloro compounds are unstable, thereby requiring constant upstream supply of these oxidising agents.

In the chemical neutralisation method based on reductive degradation of SM, SM is detoxified into gaseous products by reaction of sodium in the presence of liquid ammonia. This method is also known as solvated electron system. A disadvantage of such a process is that large quantity of sodium is required to neutralise SM completely and sodium poses considerable difficulties in storage and handling due to its high reactivity and fire hazards. Another disadvantage is that large quantity of alcohol is required to destroy the unreacted sodium after the reaction with the result that large quantity of effluent is generated and also large quantities of inflammable hydrogen gas is also generated which poses fire hazards. Still another disadvantage is that to make liquid ammonia required for such a method, the liquification of ammonia requires large quantity of liquid nitrogen which makes overall process very costly. Further the gaseous products formed after the reductive degradation of SM cause environmental hazards, so it is not ecofriendly.

Another method known for the destruction of SM is based on chemical processes of low corrosive or non-corrosive nature. For this purpose, various thiophilic agents are used as non-corrosive destruction agents for chemical destruction of SM. The thiophilic agents are formed by dissolving sulphur in liquid ammonia or alkyl amine. One of the method known in the art for preparation of thiophilic agent is by dissolving sulphur in diethylenetriamine. SM is then converted into cyclic compound by reacting thiophilic agent with SM at room temperature for a period of 24 hours. Hexane is used for isolation and extraction of cyclic product after chemical conversion of SM. A major disadvantage of such process is the long reaction time of the order of 24 hours, and that diethylenetriamine used in the process cannot be recovered and recycled with the result that unreacted amine goes into the effluent which poses environment hazards. Another disadvantage is that hexane used as an organic solvent in the process has a low boiling point which poses fire hazard. Still another disadvantage is that the use of large quantities of hexane and the inability to recover and recycle the unreacted diethylenetriamine, makes the process costly, particularly for upscaling.

OBJECTS OF THE INVENTION

The primary object of the present invention is to propose an improved process for chemical destruction of SM through chemical conversion into non-toxic products.

Another object of the present invention is to propose a process for destruction of SM in which SM is converted completely into non-toxic and non-corrosive products which can be handled easily.

Still another object of the present invention is to propose a process for chemical destruction of SM which is ecofriendly.

Yet another object of the present invention is to propose a process for chemical destruction of SM which is time-efficient as requires a period of only 30–60 minutes for complete destruction of SM into non-toxic products.

Further object of this invention is to propose a process for chemical destruction of SM which involves the use of low cost, commonly available chemicals which makes the process cost-effective and more suitable for upscaling. Still further object of this invention is to propose a process for chemical destruction of SM wherein conversion efficiency of the process to convert SM into non-toxic products is 100%.

Yet another object of this invention is to propose a process for destruction of SM which does not require the use of any toxic corrosive organic solvents.

DESCRIPTION OF INVENTION

According to this invention there is provided a process for destruction of sulphur mustard reacting sulphur mustard with a thiophilic agent prepared by dissolving sulphur in ethylenediamine and/or ethanol diamine.

Further according to this invention there is provided a thiophilic reagent comprising sulphur dissolved in ethylenediamine and/or ethanol diamine and at a concentration of 3 to 10 w/w.

The present invention envisages a process destruction of SM through chemical conversion of SM into non-toxic cyclic and polymeric products. The chemical process involves reacting SM with a thiophilic reagent. The thiophilic agent of this invention is prepared by dissolving sulphur in ethylenediamine or ethanol diamine or a combination thereof whereas the processes known in the art use diethylenetriamine. The ethylenediamine used in the present invention can be recovered and recycled making the process ecofriendly and cost-effective. The process of the present invention is highly time-efficient as it takes only 30–60 minutes for complete destruction of SM. The process of the present invention enables 100% conversion of SM into non-toxic products, whereas in the known. process, the conversion of SM into cyclic products is of the order of 99–99.8% only. In the known process, conversion of SM is carried out at room temperature whereas in the present invention, the conversion of SM into non-toxic products is carried out at 50–70° C. The non-toxic products formed after the reaction can be separated simply by filtration and the filtrate can be used again, where as in the known process organic solvents are used for the extraction of cyclic products which leads to large volumes of effluents.

According to the present invention, the proposed process for the destruction of SM comprises following steps:

1. Preparation of thiophilic agent
   a. Dissolving the commercially available sulphur powder in ethylenediamine (commercally available, purity above 95%). Concentration of sulphur in ethylenediamine is kept between 3–10% preferably 4–6% w/w.
   b. Removing any undissolved portion.
2. Conversion of SM
   a. Mixing SM with above thiophilic reagent in 1:4 to 1:10, preferably 1:5 to 1:7;
   b. Stirring the reaction mixture at 40–100° C. for 10–180 minutes preferably 50–70° C. for 20–60 minutes;
   c. Cooling the reaction mixture to room temperature;
   d. Filtering the reaction mixture through nutche filter;
   e. Recovering amine from the solid by passing hot air;
   f. Analysis of the filtrates to check the presence of SM. If traces of SM is found in the filtrate then repeat the process by adding more sulphur in the reaction mixture.

This invention will now be illustrated with an example, which is intended to be an illustrative example and is not intended to be taken restrictively to imply any limitation on the scope of the present invention.

EXAMPLE

Ethylenediamine (1.5 L) is taken in a round bottom flask equipped with condenser and dropping funnel to which sulphur (76 gms) is added with continuous stirring. The this sulphur mustard (250 gms) is added. After the complete addition of SM, the reaction mixture is heated to 65° C. for 60 minutes with continuous stirring. After 60 minutes, the reaction mixture is cooled at room temperature and filtered through nutche filter. The filtrate is kept for further reaction. The solid is analysed by Gas Liquid chromatography to find out the percentage conversion after extraction with chloroform. The dried solid so obtained can be stored as non-toxic solid. The 100% conversion of SM to non-toxic products is thus achieved. The non-toxic nature of the products are confirmed by animal experiments using mice and $LD_{50}$ value was found to be grater than 5 gm per kg body weight.

It is to be understood that the above description of the present investigation is susceptible to considerable modifications, change and adaptation by those skilled in the art, such modifications are intended to be considered to be within the scope of the present invention, which is set forth by following claims.

What is claimed is:

1. A process for mass destruction of sulphur mustard by chemical conversion, comprising the steps of:

preparing a thiophilic agent by dissolving from 3 to 10% by weight of sulphur in at least one amine substance selected from the group consisting of ethylenediamine and ethanol diamine;

reacting sulphur mustard with the thiophilic agent in a ratio of sulphur mustard to thiophilic agent ranging from 1:4 to 1:10 to convert the sulphur mustard and obtain reaction products including non-toxic reaction products of sulphur mustard;

filtering the reaction products to obtain a solid phase containing the non-toxic reaction products of sulphur mustard and a liquid phase containing residual amounts of said at least one amine substance;

extracting said at least one amine substance from the liquid phase without use of any organic solvent to recover said at least one amine substance and a residual liquid phase; and recycling said at least one amine substance extracted from the liquid phase for preparing the thiophilic agent.

2. The process as claimed in claim 1, wherein the ratio of sulphur mustard to thiophilic agent ranges from 1:5 to 1:7.

3. The process as claimed in claim 1, wherein reaction between the thiophilic agent and the sulphur mustard is carried out at a temperature ranging from 40 to 100° C.

4. The process as claimed in claim 1, wherein reaction between the thiophilic agent and the sulphur mustard is carried out at a temperature ranging from 50 to 70° C.

5. The process as claimed in claim 1, wherein reacting sulphur mustard with the thiophilic agent takes place for a reaction time which is effective to substantially chemically convert the sulphur mustard into non-toxic reaction products thereof.

6. The process as claimed in claim 1, wherein reacting sulphur mustard with the thiophilic agent takes place for a reaction time which ranges from 10 to 30 minutes.

7. The process as claimed in claim 1, wherein the residual liquid phase contains at least one amine substance, and wherein the process further comprises subjecting the residual liquid phase to hot air treatment to further recover the at least one amine substance.

* * * * *